US005214474A

United States Patent [19]

Ishizuka

[11] Patent Number: 5,214,474

[45] Date of Patent: May 25, 1993

[54] COPYING APPARATUS

[75] Inventor: Yoshiyuki Ishizuka, Hirakata, Japan

[73] Assignee: Mita Industrial Co., Ltd., Osaka, Japan

[21] Appl. No.: 857,763

[22] Filed: Mar. 26, 1992

[30] Foreign Application Priority Data

Mar. 28, 1991 [JP] Japan ..... 3-64545

[51] Int. Cl.[5] ..... G03G 15/24; G03G 15/02; G03G 15/04

[52] U.S. Cl. ..... 355/220; 355/208; 355/214; 355/219; 355/228

[58] Field of Search ..... 355/219, 220, 203, 204, 355/207, 208, 228, 67, 69, 214

[56] References Cited

U.S. PATENT DOCUMENTS

| | | | |
|---|---|---|---|
| 4,912,508 | 3/1990 | Zawadzki et al. | 355/208 |
| 4,924,265 | 5/1990 | Patilla et al. | 355/204 |
| 5,053,818 | 10/1991 | Smith | 355/214 |

FOREIGN PATENT DOCUMENTS

| | | | |
|---|---|---|---|
| 0107271 | 8/1981 | Japan | 355/208 |
| 0172365 | 10/1982 | Japan | 355/204 |
| 0106573 | 6/1983 | Japan | 355/228 |
| 0106574 | 6/1983 | Japan | 355/228 |
| 0125071 | 7/1983 | Japan | 355/228 |
| 0091972 | 4/1987 | Japan | 355/204 |
| 0231466 | 9/1988 | Japan | 355/204 |
| 0100068 | 4/1990 | Japan | 355/204 |
| 0201348 | 8/1990 | Japan | 355/228 |
| 0029969 | 2/1991 | Japan | 355/204 |

*Primary Examiner*—Fred L. Braun
*Assistant Examiner*—Matthew S. Smith
*Attorney, Agent, or Firm*—Renner, Otto, Boisselle & Sklar

[57] ABSTRACT

The intensity of a light emitted from a light source and reflected on a document is detected by an exposure sensor. A control section controls an exposure adjusting circuit to adjust an intensity of the light emitted from the light source based on a detection result of the exposure sensor, and simultaneously controls a potential adjusting circuit to adjust a potential of a surface of a photoconductive drum through a charging device.

2 Claims, 1 Drawing Sheet

COPYING APPARATUS

BACKGROUND OF THE INVENTION

1. Field of the Invention

The present invention relates to an electrostatic copying apparatus such as an electrophotographic copying apparatus.

2. Description of the Prior Art

Generally in an electrophotographic copying apparatus, an image is formed by the use of a photoconductive drum. In the state where the photoconductive drum is uniformly charged by a charging device so as to have a specified potential on a surface thereof, the photoconductive drum is exposed by a light emitted from a light source and reflected on a background of a document. An exposed portion of the surface, which corresponds to the background of the document, is turned conductive so as to allow the potential thereof to be lowered. As a result, an electrostatic latent image corresponding to an image of the document is formed on the photoconductive drum. A portion of the surface which is not exposed by the light and therefore has a high potential is developed with a toner which is charged to have a polarity opposite to that of the photoconductive drum. A toner image thus formed is transferred onto a recording paper and is then fixed, whereby a copy image is formed.

In the case that the background of the document has a poor reflectance, as in the case of a newspaper, there is a possibility that the potential of the exposed portion of the surface of the photoconductive drum corresponding to the background of the document is not sufficiently lowered by the light reflected on the background, thereby undesirably allowing the toner to be adhered on the exposed portion. Such a phenomenon results in an unclear image having a so-called fog. This phenomenon is avoided by heightening the intensity of the light emitted from the light source so as to lower more certainly the potential of the exposed portion corresponding to the background.

Recently, the optical system in the copying apparatus has been provided with a red filter in order to enhance the photosensitivity of the photoconductive drum to a red image of the document.

In a copying apparatus having the red filter in the optical system, the light emitted toward the photoconductive drum is partially shielded by the red filter, thereby lowering the intensity thereof. Accordingly, the potential of the exposed portion corresponding to the background of the document is not sufficiently lowered, which allows the toner to be adhered on the exposed portion. As a result, an image which is unclear due to a fog is formed on the recording paper. Especially in the case that the photoconductive drum is rotated at a high speed for the purpose of a high speed image formation, the intensity of the light emitted toward the photoconductive drum is further lowered, thereby increasing the possibility of a fog being generated.

Even in a copying apparatus constructed to heighten the intensity of the light emitted from the ground with a poor reflectance, the red filter lowers the light intensity, thereby not allowing the potential of the surface to be sufficiently lowered.

SUMMARY OF THE INVENTION

The copying apparatus of this invention, which overcomes the above-discussed and numerous other disadvantages and deficiencies of the prior art includes: a photoconductive drum; a charging device for charging the photoconductive drum; a light source for emitting a light to expose a document; a lens unit, through which light reflected on the document is transmitted to expose the photoconductive drum charged by the charging device to form an electrostatic latent image is the photoconductive drum; a developing device for developing the electrostatic latent image; an exposure adjusting device for adjusting an exposure of the photoconductive drum to the light emitted from the light source and reflected on the document by changing an intensity of the light emitted from the light source; a potential adjusting device for adjusting a potential of the photoconductive drum through the charging device; and a control device for controlling the exposure adjusting device to adjust the exposure and simultaneously controlling the potential adjusting device to adjust the potential.

In a preferred embodiment of the invention, the exposure adjusting device and the potential adjusting device are controlled to adjust the exposure and the potential based on the intensity of the light emitted from the light source and reflected on the document.

In a preferred embodiment of the invention, the exposure adjusting device is controlled to heighten the exposure, and the potential adjusting device is controlled to lower the potential in the case that the intensity of the light is lower than a reference value. Moreover, the exposure adjusting device is controlled to lower the exposure, and the potential adjusting device is controlled to heighten the potential in the case that the intensity of the light is higher than the reference value.

In a preferred embodiment of the invention, the lens unit has a red filter through which the light for exposing the photoconductive drum is transmitted.

In a preferred embodiment of the invention, the exposure adjusting device is controlled to adjust the exposure to a predetermined value and the potential adjusting device is controlled to adjust the potential to a predetermined value, in accordance with a setting mode.

Alternatively, the copying apparatus of this invention includes a device for providing charge to a photoconductive surface; a device for exposing the photoconductive surface to a light to form an electrostatic latent image on the photoconductive surface; a detecting device for detecting an intensity of the light and for providing a signal as a function of the detected intensity; an exposure adjusting device for adjusting a degree of exposure of the photoconductive surface to the light as a function of the signal; and a potential adjusting device for adjusting an amount of charge provided by the device for providing charge, as a function of the signal.

In a preferred embodiment of the invention, the exposure adjusting device and the potential adjusting device simultaneously adjust the degree of exposure and the amount of charge.

In a preferred embodiment of the invention, the exposure adjusting device comprises a device for adjusting the intensity of the light.

Alternatively, the method of this invention for controlling a copy apparatus having a photoconductive surface which is charged and is exposed to light to form an electrostatic latent image includes the steps of detecting an exposure level of the photoconductive surface; adjusting an intensity level of the light as a function of the exposure level; and adjusting a charge level of the photoconductive surface as a function of the exposure level.

In a preferred embodiment of the invention, the steps of adjusting the intensity level and the charge level are performed simultaneously.

In a copying apparatus according to the present invention, when the intensity of the light emitted from the light source is heightened by the exposure adjusting device, the potential of the surface of the photoconductive drum is simultaneously lowered by the potential adjusting device.

Thus, the invention described herein makes possible the objective of providing a copying apparatus for reliably forming an image having no fog even in the case that the optical system is equipped with a filter or the photoconductive drum is rotated at a high speed.

BRIEF DESCRIPTION OF THE DRAWING

This invention may be better understood and its numerous objects and advantages will become apparent to those skilled in art by reference to the accompanying drawing as follows.

DESCRIPTION OF THE PREFERRED EMBODIMENT

Figure 1:
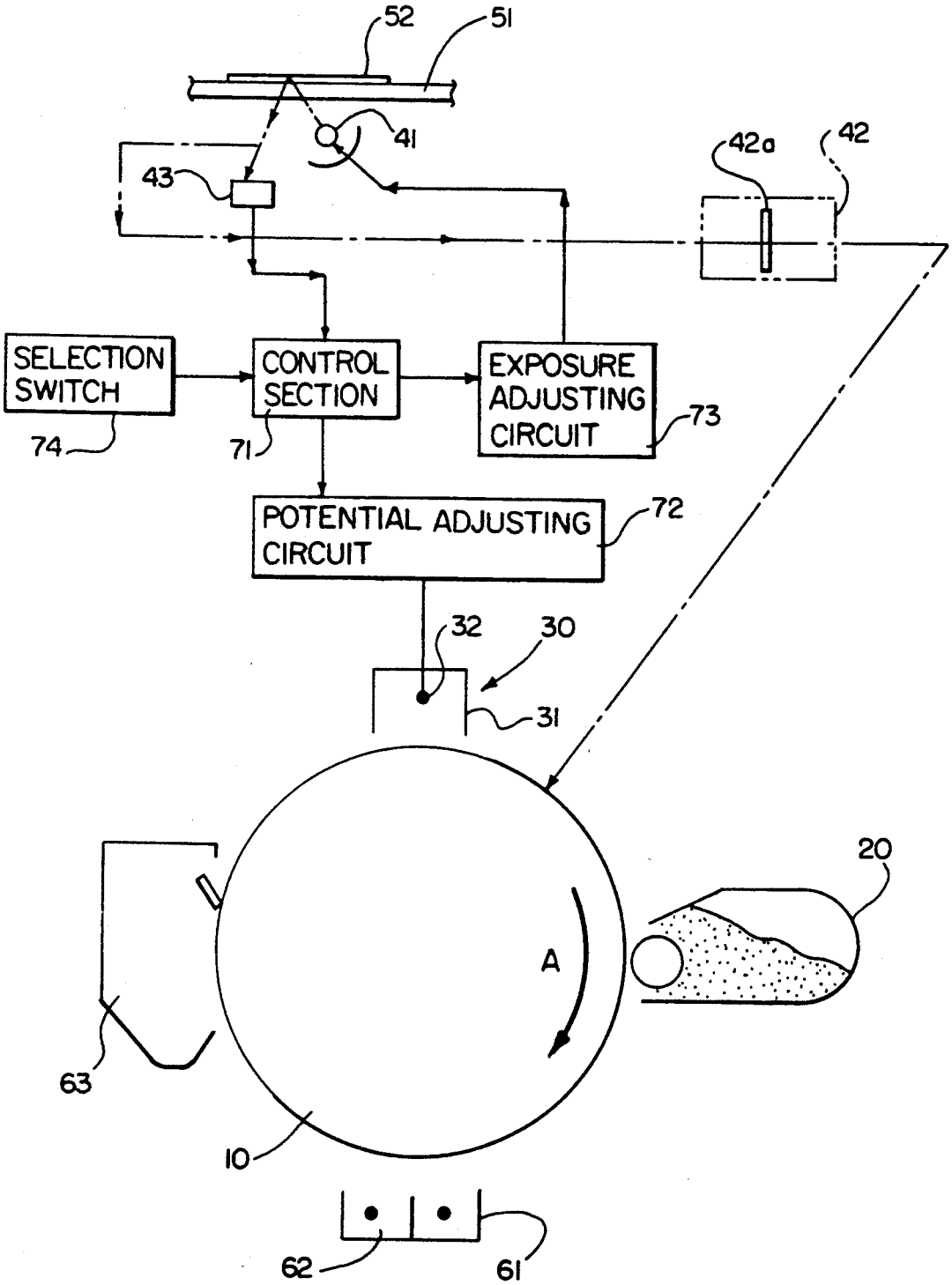
FIG. 1 is a schematic view illustrating a construction of an embodiment of this invention together with a block diagram of a control system.

The present invention will be described by way of illustrating an embodiment with reference to the accompanying drawing.

As is shown in FIG. 1, an electrophotographic copying apparatus according to the present invention comprises a photoconductive drum 10 disposed at a substantial center of the apparatus. A charging device 30 is provided above the photoconductive drum 10, whereby a surface of the photoconductive drum 10 is charged to have a specified potential. The charging device 30 comprises a box-shaped charger 31 opened toward the photoconductive drum 10 and a charging wire 32 stretched in the charger 31. The charging wire 32 is connected to a potential adjusting circuit 72, whereby the voltage applied to the charging wire 32 is adjusted by the potential adjusting circuit 72 in order to change the potential of a surface of the photoconductive drum 10. The potential adjusting circuit 72 is controlled by a control section 71.

The photoconductive drum 10 charged by the charging device 30 is exposed to light which is emitted from a light source 41 of an optical system, is reflected on a document 52 placed on a document table 51, and passes through a lens unit 42. By such exposure, the potential of an exposed portion of the surface of the photoconductive drum 10 is lowered compared with a portion which is not exposed. A difference in surface potential thus obtained serves to form an electrostatic latent image corresponding to an image of the document 52. The lens unit 42 is provided with a red filter **42*a* for emphasizing a light reflected on a red portion of the image on the document 52**.

A portion of the light emitted from the light source 41 and reflected on the document 52 is received by an exposure sensor 43. The light source 41 is connected to an exposure adjusting circuit 73, whereby the voltage applied to the light source 41 is adjusted by the exposure adjusting circuit 73 so as to change the intensity of the light emitted from the light source 41. The exposure adjusting circuit 73 also is controlled by the control section 71.

The electrostatic latent image formed on the photoconductive drum 10 is developed by developing device 20, whereby a toner image is formed on the photoconductive drum 10. The toner image is transferred onto a recording paper by a transfer device 61, and then the recording paper is separated from the photoconductive drum 10 by a separating device 62. The residual toner on the photoconductive drum 10 is removed by a cleaning device 63.

The control section 71 is connected to a selection switch 74, by which an automatic mode or an exposure changing mode is selected. In the case that the automatic mode is selected, the intensity of the light emitted from the light source 41 is automatically heightened or lowered based on the intensity of the light reflected on the document 52 and received by the exposure in the case that the background of the document 52 is colored and therefore has a poor reflectance as in the case of a newspaper.

In an electrophotographic copying apparatus having the above construction, when the automatic mode is selected by the selection switch 74, the control section 71 controls the intensity of the light emitted from the light source 41 based on a detection result of the exposure sensor 43. In this case, before the document 52 is scanned and thus exposed to the light the intensity of the light emitted from the light source 41 is adjusted in the state where the light is emitted from the light source 41, as will be described hereinafter. When the intensity of the light reflected on the background of the document 52 is detected by the exposure sensor 43, the control section 71 controls the exposure adjusting circuit 73 based on the detection result of the exposure sensor 43 to adjust the intensity of the light emitted from the light source 41. Simultaneously, the control section 71 controls the potential adjusting circuit 72 to adjust the potential of the photoconductive drum 10 through the charging device 30. For example, in the case that the intensity of the light received by the exposure sensor 43 is lower than a reference value, the control section 71 controls the exposure adjusting circuit 73 to heighten the intensity of the light emitted from the light source 41 and simultaneously controls the potential adjusting circuit 72 to lower the potential of the photoconductive drum 10 through the charging device 30.

Accordingly, the image of the document 52 is exposed by a light having a high intensity from the light source 41. Although the background of the document 52 has a poor reflectance, the intensity of the light is still kept relatively high even after the light is reflected on the background. Therefore, the photoconductive drum 10 is exposed by the light having the relatively high intensity. Further, since the photoconductive drum 10 is uniformly charged to have a low potential in this case, the potential of the exposed portion is certainly lowered. In consequence, there is no possibility that the toner is adhered on the exposed portion when the electrostatic latent image is developed by the developing device 20. As a result, a clear image having no fog can be formed.

In the case that the intensity of the light received by the exposure sensor 43 is higher than the reference value, the control section 71 controls the exposure adjusting circuit 73 to lower the intensity of the light emitted from the light source 41 and simultaneously controls the potential adjusting circuit 72 to heighten the potential of the photoconductive drum 10 through the charging device 30.

In the case that the exposure changing mode is selected by the selection switch 74, the control section 71 controls the exposure adjusting circuit 73 to adjust the intensity of the light emitted from the light source 41 to a predetermined value and also controls the potential adjusting circuit 72 to adjust the potential of the photoconductive drum 10 to a predetermined value.

According to the present invention, the intensity of the light emitted from the light source 41 and the potential of the photoconductive drum 10 are simultaneously adjusted. Consequently, a clear image having no fog can certainly be formed simply by changing the intensity of the light emitted from the light source 41 within a narrow range, even in the case that the intensity of the light reflected on the document 52 is lowered by the filter 42*a* of the lens unit 42 or in the case that the photoconductive drum 10 is rotated at a high speed and changing the intensity of the light emitted from the light source 41 is not enough to avoid the generation of a fog.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A copying apparatus, comprising:

a photoconductive drum;

a charging device for charging the photoconductive drum;

a light source for emitting a light to expose a document;

a lens unit, through which light reflected on the document is transmitted to expose the photoconductive drum charged by the charging device to form an electrostatic latent image on the photoconductive drum;

a developing device for developing the electrostatic latent image;

exposure adjusting means for adjusting an exposure of the photoconductive drum to the light emitted from the light source and reflected on the document by changing an intensity of the light emitted from the light source;

potential adjusting means for adjusting a potential of the photoconductive drum through the charging device; and control means for controlling the exposure adjusting means to adjust the exposure and simultaneously controlling the potential adjusting means to adjust the potential, based on the intensity of the light emitted from the light source and reflected on the document, wherein the exposure adjusting means is controlled to heighten the exposure and the potential adjusting means is controlled to lower the potential in the case that the intensity of the light is lower than a reference value, and the exposure adjusting means is controlled to lower the exposure and the potential adjusting means is controlled to heighten the potential in the case that the intensity of the light is higher than the reference value.

2. A copying apparatus according to claim 1, wherein the lens unit has a red filter, through which the light for exposing the photoconductive drum is transmitted.

* * * * *